US009358807B2

(12) United States Patent
Yano et al.

(10) Patent No.: US 9,358,807 B2
(45) Date of Patent: Jun. 7, 2016

(54) OPTICAL PRINT HEAD AND IMAGE FORMING APPARATUS

(71) Applicant: Konica Minolta, Inc., Chiyoda-ku, Tokyo (JP)

(72) Inventors: So Yano, Ibaraki (JP); Yoshikazu Watanabe, Toyohashi (JP); Makoto Obayashi, Toyokawa (JP); Masayuki Iijima, Okazaki (JP); Takaki Uemura, Seto (JP); Satoshi Masuda, Neyagawa (JP)

(73) Assignee: KONICA MINOLTA, INC (JP)

( * ) Notice: Subject to any disclaimer, the term of this patent is extended or adjusted under 35 U.S.C. 154(b) by 0 days.

(21) Appl. No.: 14/619,476

(22) Filed: Feb. 11, 2015

(65) Prior Publication Data

US 2015/0239258 A1 Aug. 27, 2015

(30) Foreign Application Priority Data

Feb. 24, 2014 (JP) ..... 2014-032640

(51) Int. Cl.
*B41J 2/435* (2006.01)
*B41J 2/47* (2006.01)
*B41J 2/45* (2006.01)

(52) U.S. Cl.
CPC ..... *B41J 2/45* (2013.01)

(58) Field of Classification Search
USPC ..... 347/236–238, 240, 246, 247, 251–254; 315/149, 150, 169.3
See application file for complete search history.

(56) References Cited

U.S. PATENT DOCUMENTS 6,376,994 B1 4/2002 Ochi et al.
6,504,565 B1 1/2003 Narita et al.
7,948,509 B2 * 5/2011 Yamazaki et al. ..... 347/130
(Continued)

FOREIGN PATENT DOCUMENTS

JP 2000094742 A 4/2000
JP 2000214824 A 8/2000
(Continued)

OTHER PUBLICATIONS

Japanese Notification of Reasons for Refusal corresponding to Application No. 2014-032640; Date of Mailing: Mar. 1, 2016, with English translation.

*Primary Examiner* — Hai C Pham
(74) *Attorney, Agent, or Firm* — Cantor Colburn LLP

(57) ABSTRACT

An optical print head performs optical writing onto target, and includes: current-driven light-emitting elements arranged in rows in a predetermined direction; driving transistors that are each electrically series-connected with the light-emitting elements in one-to-one correspondence, and each supply a driving current to a corresponding light-emitting element; a current control unit that controls, for each light-emitting element, a driving current amount in accordance with variation in light-emitting properties of the light-emitting element that indicate relation between the driving current amount and a light amount emitted by the light-emitting element; an application unit that, upon receiving electrical power supplied from an external power source, applies application voltage to circuits each consisting of a light-emitting element and a corresponding driving transistor; and a voltage control unit that suppresses variation in divided voltage applied to each driving transistor by controlling the application unit to apply increased application voltage of the driving current amount increases.

17 Claims, 16 Drawing Sheets

(56) References Cited

U.S. PATENT DOCUMENTS

| | | | | |
|---|---|---|---|---|
| 2008/0088545 | A1* | 4/2008 | Chen et al. | 345/76 |
| 2009/0079727 | A1* | 3/2009 | Ozawa | 345/214 |
| 2009/0122129 | A1* | 5/2009 | Tsujino et al. | 347/238 |

FOREIGN PATENT DOCUMENTS

| | | | |
|---|---|---|---|
| JP | 200330418 | A | 11/2003 |
| JP | 2006056010 | A | 3/2006 |
| JP | 2008003456 | A | 1/2008 |

* cited by examiner

Present embodiment

FIG. 15

| Details of source voltage of 16 V | | Voltage | Remarks |
|---|---|---|---|
| TFT | $V_{DS}$ | 3 V | Voltage for operations |
| OLED | Temporal deterioration | 3 V | From initial stage to end of operating life |
| | Variation in environmental temperature | 2 V | Driving at 10°C |
| | Unevenness in properties | 2 V | Add 2 V at most in accordance with unevenness |
| | Minimum voltage for light emission | 6 V | Driving at 50°C |
| Total of voltage | | 16 V | — |

OPTICAL PRINT HEAD AND IMAGE FORMING APPARATUS

CROSS-REFERENCE TO RELATED APPLICATIONS

The present invention claims priority under 35 U.S.C. §119 to Japanese Application No. 2014-032640 filed Feb. 24, 2014, the entire content of which is incorporated herein by reference.

BACKGROUND OF THE INVENTION (1) Field of the Invention

The present invention relates to an optical print head (PH) and an image forming apparatus, and particularly to an art of increasing resolution without increasing the device size.

(2) Related Art

In recent years, there have been proposed optical PHs in order to reduce the size and the cost of image forming apparatuses using organic light-emitting diodes (OLEDs). Since it is possible to form, on the same substrate, the OLEDs and thin-film transistors (TFTs) that supply a driving current to the OLEDs, the cost reduction of the optical PHs can be achieved.

Unfortunately, an amount of light emitted by the OLEDs decreases in accordance with an accumulated light-emitting period and luminescence intensity during thereof. For this reason, application of OLEDs to optical PHs causes unevenness in degree of decrease in light amount between pixels caused by unevenness in accumulated light-emitting period of the OLEDs and luminescence intensity during thereof between pixels depending on each image to be written. This might deteriorate the image quality.

In response to this problem, there has been proposed an art of adjusting a light amount of OLEDs by adjusting a gate voltage of TFTs that supply a driving current to the OLEDs (see Japanese Patent Application Publication No. 2006-056010 for example). This adjustment of the gate voltage corrects unevenness in light amount between the OLEDs and temporal deterioration of the OLEDs.

Similarly, in response to a problem of unevenness in degree of decrease in light amount between the OLEDs due to environmental temperature of the OLEDs, the adjustment of the gate voltage also allows the OLEDs to emit light of a uniform light amount.

Note that a relation between an amount of a driving current to be supplied to each of the OLEDs and an amount of light emitted by the OLED is hereinafter referred to as light-emitting properties.

SUMMARY OF THE INVENTION

In order to cause OLEDs to emit light of a uniform light amount, it is necessary to adjust a driving current amount and an application voltage in accordance with the degree of decrease in light amount due to the accumulated light-emitting period and the environmental temperature. For this reason, the above conventional art uses a power source having a source voltage that is set comparatively high in consideration of compensating the decrease in light amount due to temporal deterioration of the OLEDs, variation in environmental temperature of the OLEDs, unevenness in initial light-emitting properties between the OLEDs, and so on. In the case where there is no or less decrease in light amount, a redundant voltage is absorbed by using the TFTs.

Description is given with use of an example where the source voltage in the conventional art is set to 16 V. In the case where a design value of the minimum voltage necessary for the OLEDs to emit light is 6 V, the following values of a voltage need to be estimated as a variation width as shown in FIG. 15: a voltage of 2 V for compensating the variation in light amount due to the environmental temperature; a voltage of 2 V for compensating the unevenness in initial light-emitting properties between the OLEDs; and a voltage of 3 V for compensating the temporal deterioration of the OLEDs that occurs by the end of the operating life of the OLEDs.

Addition of the values of the variation width results in 13 V as the maximum value of the application voltage of the OLEDs. Furthermore, a voltage of 3 V is added as a source-drain voltage $V_{DS}$ to be applied for operating the TFTs. As a result, a source voltage necessary for driving the OLEDs is 16 V.

In the case where this voltage of 16 V is always supplied from a fixed voltage source, the source-drain voltage $V_{DS}$ of the TFTs reaches 10 V at most because the minimum voltage necessary for the OLEDs to emit light is 6 V (see FIG. 16). Therefore, it is necessary to select TFTs that have a breakdown voltage resistant to breakdown even when the source-drain voltage $V_{DS}$ of 10 V is applied.

FIG. 12 shows graphs of a relation between a source-drain breakdown voltage and the minimum value of effective channel length of a TFT. The channel length indicates length of a channel layer constituting the TFT. As the channel length is longer, the source-drain breakdown voltage is higher. In FIG. 12, an adapted region 1201, which indicates effective channel length longer than that indicated by a graph 1200, expresses a sufficient breakdown voltage, and an unadapted region 1202 expresses an insufficient breakdown voltage. As shown in FIG. 12, when the source-drain breakdown voltage is 10 V, effective channel length of 15 μm or longer is necessary.

The channel length and the size of the TFT are in a relation shown in FIG. 13. In FIG. 13, the horizontal axis represents the channel length, and the vertical axis represents the size of the TFT. Also, a graph 1301 represents the size in the longitudinal direction of the TFT, and a graph 1302 represents the size of the width direction of the TFT. The size of the TFT relating to the conventional art is estimated as follows from the relation shown in FIG. 13. When channel length is estimated to 20 μm by adding a geometric margin to an effective channel length of 15 μm, the TFT relating to the conventional art is estimated to have the size of 80 μm in the longitudinal direction and 25 μm in the width direction.

The TFT, which has the size of 80 μm in the longitudinal direction and 25 μm in the width direction, is considered to be arranged such as shown in FIG. 17. FIG. 17 shows arrangement estimated with respect to the OLEDs and the TFTs relating to the conventional art. According to an optical PH having a resolution of 1200 dpi, pixels (OLEDs 1701) are arranged at pitches of 21.2 μm in the main scanning direction, and TFTs 1702 cannot be arranged in a single row in the main scanning direction. Accordingly, the TFTs 1702 need to be arranged in the main scanning direction in two or more rows that are separated in the sub scanning direction.

As a result, the TFT substrate has no choice to be increased in size in the sub scanning direction, thereby causing the cost increase.

The present invention was made in view of the above problem, and aims to provide an optical PH in which the substrate size is reduced by arranging driving TFTs in a single row in the main scanning direction without decreasing resolution, and an image forming apparatus including the optical PH.

In order to achieve the above aim, the present invention provides an optical print head that performs optical writing onto a target, the optical print head comprising: a plurality of current-driven light-emitting elements that are arranged in rows in a predetermined direction; a plurality of driving transistors that are each electrically series-connected with the light-emitting elements in one-to-one correspondence, and each supply a driving current to a corresponding one of the light-emitting elements; a current control unit that controls, for each of the light-emitting elements, an amount of the driving current in accordance with variation in light-emitting properties of the light-emitting element, the light-emitting properties indicating a relation between the amount of the driving current and an amount of light emitted by the light-emitting element; an application unit that, upon receiving electrical power supplied from an external power source, applies an application voltage to circuits that each consist of one of the light-emitting elements and a corresponding one of the driving transistors; and a voltage control unit that suppresses variation in a divided voltage to be applied to each of the driving transistors by controlling the application unit to apply an increased application voltage as the amount of the driving current increases.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings:

FIG. 10 shows magnitude of respective divided voltages of OLED driving TFT 431 and the OLED 201 that are divided from a source voltage applied to the light-emitting block 400 while the OLED 201 is turned on.

FIG. 15 is a table showing the details of set values of a source voltage relating to the conventional art.

DESCRIPTION OF PREFERRED EMBODIMENTS

The following describes an embodiment of an optical PH and an image forming apparatus relating to the present invention, with reference to the drawings.

[1] Configuration of Image Forming Apparatus

First, description is given on the configuration of an image forming apparatus relating to the present embodiment.

Figure 1:
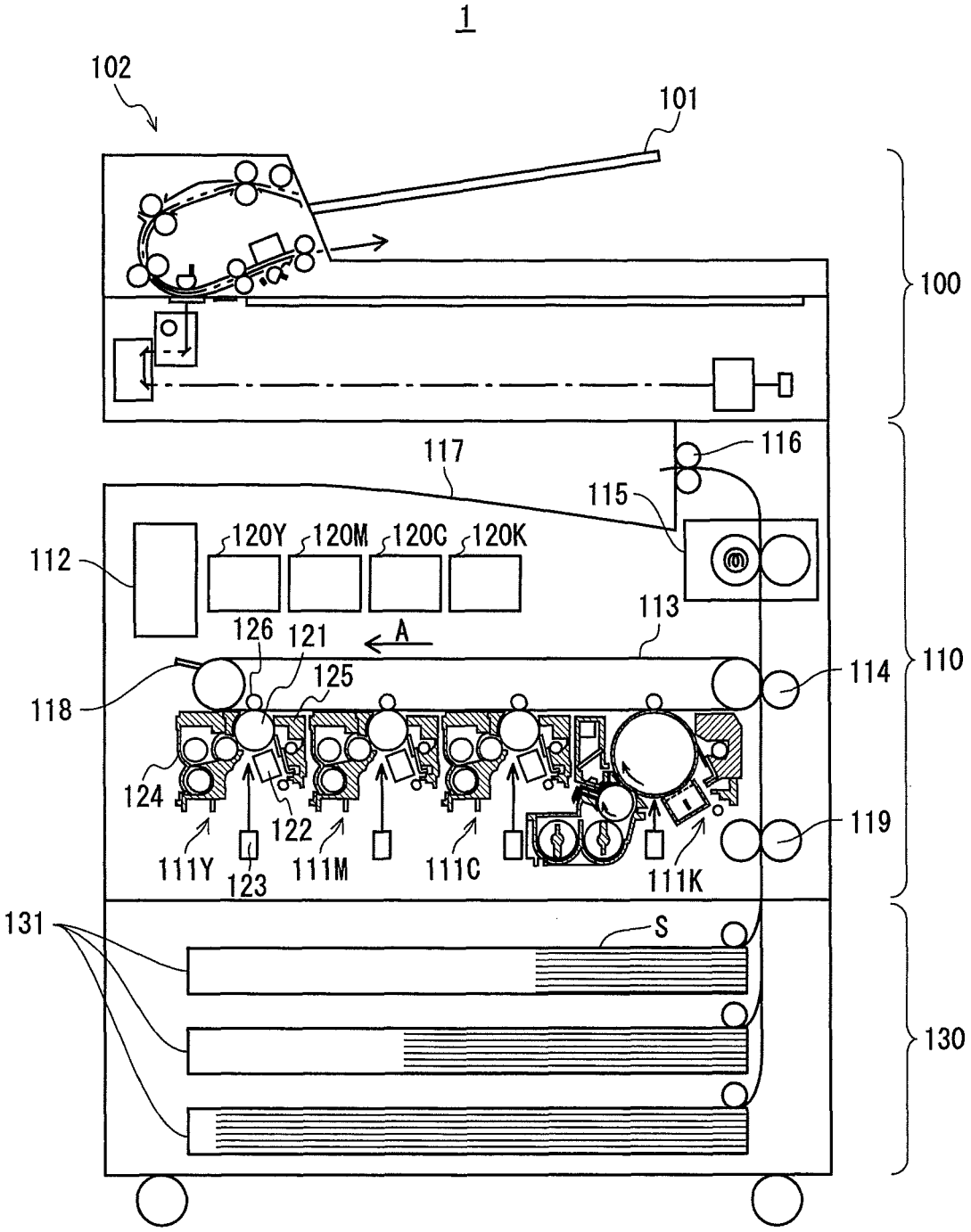
FIG. 1 shows the main configuration of an image forming apparatus relating to an embodiment of the present embodiment.

FIG. 1 shows the main configuration of the image forming apparatus relating to the present embodiment. As shown in FIG. 1, an image forming apparatus 1 is a so-called tandem-type color multifunction machine, and includes a document scanning unit 100, an image forming unit 110, and paper feed unit 130. While conveying documents placed on a document tray 101 by an automatic document feeder (ADF) 102, the document scanning unit 100 optically scans each of the documents to generate image data of the document. The image data is stored in a control unit 112 which is described later.

The image forming unit 110 includes image forming subunits 111Y to 111K, the control unit 112, an intermediate transfer belt 113, a pair of secondary transfer rollers 114, a fixing device 115, a pair of paper ejection rollers 116, a paper ejection tray 117, a cleaning blade 118, and a pair of timing rollers 119. Also, the image forming unit 110 has attached thereto toner cartridges 120Y to 120K that feed toner of respective colors of yellow (Y), magenta (M), cyan (C), and black (K).

Upon receiving toner of the respective colors of Y, M, C, and K fed from the toner cartridges 120Y, 120M, 120C, and 120K, the image forming subunits 111Y, 111M, 111C, and 111K form toner images of the respective colors of Y, M, C, and K under control by the control unit 112. The image forming subunit 111Y for example includes a photosensitive drum 121, a charging device 122, an optical PH 123, a developing device 124, and a cleaning device 125. The charging device 122 uniformly charges an outer circumferential surface of the photosensitive drum 121 under the control by the control unit 112.

The control unit 112 includes an application specific integrated circuit (ASIC) (hereinafter, referred to as luminance signal output unit), and generates a digital luminance signal for causing the optical PH 123 to emit light, based on image data for printing included in a received job. As described later, the optical PH 123 includes light-emitting elements (OLED) that are arranged in line in the main scanning direction, and performs optical writing on the outer circumferential surface of the photosensitive drum 121 by causing each of the OLEDs to emit light in accordance with the digital luminance signal generated by the control unit 112, and thereby to form an electrostatic latent image.

The developing device 124 feeds toner to the outer circumferential surface of the photosensitive drum 121 to develop (visualize) the electrostatic latent image. A primary transfer roller 126, to which a primary transfer voltage is applied, electrostatically absorbs the toner so as to electrostatically transfer (primarily transfer) the toner image carried on the outer circumferential surface of the photosensitive drum 121 onto the intermediate transfer belt 113. Then, the cleaning device 125 scrapes residual toner on the outer circumferential surface of the photosensitive drum 121 by the cleaning blade 118, and furthermore removes electrical charge by illuminating the outer circumferential surface of the photosensitive drum 121 by a discharging lamp.

In the similar manner, the image forming subunits 111M, 111C, and 111K form toner images of the respective colors. These toner images are sequentially primarily transferred onto the intermediate transfer belt 113 so as to be superimposed on top of one another. As a result, a full-color toner image is formed. The intermediate transfer belt 113 is an endless belt-shaped rotary member, and rotates in a direction indicated by an arrow A in FIG. 1 to convey the primarily transferred toner images to the pair of secondary transfer rollers 114.

The paper feed unit 130 includes a paper feed cassette 131 that houses therein recording sheets S for each sheet size, and feeds the recording sheets S to the image forming unit 110 piece by piece. The fed recording sheets S are each conveyed while the toner image is conveyed by the intermediate transfer belt 113 to the pair of secondary transfer rollers 114 through the pair of timing rollers 119. The pair of timing rollers 119 convey the recording sheet S in accordance with a timing when the toner image reaches the pair of secondary transfer rollers 114.

The pair of secondary transfer rollers 114 are a pair of rollers to which a secondary transfer voltage is applied and are brought into pressure-contact with each other to form a secondary transfer nip. In this secondary transfer nip, the toner image carried on the intermediate transfer belt 113 is electrostatically transferred (secondarily transferred) onto the recording sheet S. The recording sheet S, onto which the toner image is transferred, is conveyed to the fixing device 115. Also, after the secondary transfer, residual toner on the intermediate transfer belt 113 is further conveyed in the direction indicated by the arrow A, and then is scraped by the cleaning blade 118 for disposal.

The fixing device 115 heats and melts the toner image so as to be pressed onto the recording sheet S. The recording sheet S, to which the toner image is fused, is ejected onto the paper ejection tray 117 by the pair of paper ejection rollers 116.

Note that the control unit 112 controls operations of the image forming apparatus 1 including an operation panel which is not illustrated. Also, the control unit 112 transmits and receives image data to and from, and receives print jobs from other apparatuses such as personal computers (PCs). Furthermore, the control unit 112 includes a facsimile modem, and transmits and receives image data from and to other facsimile apparatuses via a facsimile line.

In addition, a transfer charger or a transfer belt may be used for transferring toner images, instead of the transfer rollers. Also, a cleaning brush, a cleaning roller, or the like may be used for removing residual toner on the intermediate transfer belt 113, instead of the cleaning blade 118.

[2] Configuration of Optical PH 123

Next, description is given on the configuration of the optical PH 123.

Figure 2:
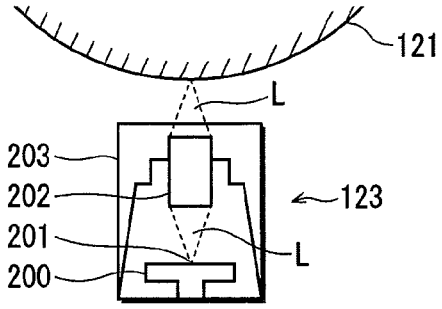
FIG. 2 is a cross-sectional view showing an optical writing operation performed by an optical PH 123.

FIG. 2 is a cross-sectional view showing an optical writing operation performed by the optical PH 123. As shown in FIG. 2, the optical PH 123 includes an OLED panel 200 and a rod lens array 202 that are housed in a housing 203. A large number of OLEDs 201 are mounted on the OLED panel 200 in line in the main scanning direction. The OLEDs 201 each emit optical beam L. Note that the OLEDs 201 may be arranged in zigzag instead of in line.

Figure 3:
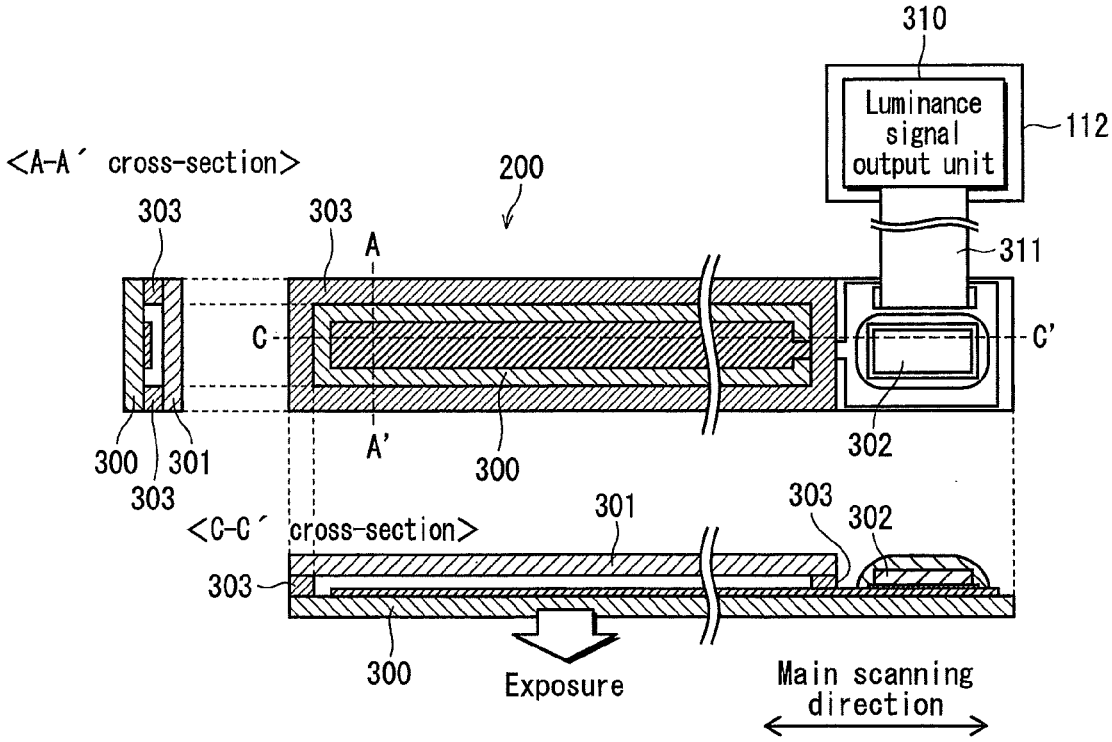
FIG. 3 is a schematic plan view showing an OLED panel 200 including a cross-sectional view taken along line A-A' and a cross-sectional view taken along line C-C'.

FIG. 3 is a schematic plan view showing the OLED panel 200 including a cross-sectional view taken along line A-A' and a cross-sectional view taken along line C-C'. The schematic plan view shows the state where a sealing plate which is descried later is removed. As shown in FIG. 3, the OLED panel 200 includes a TFT substrate 300, a sealing plate 301, a source IC 302, and so on.

The TFT substrate 300 has 15,000 OLEDs 201 arranged thereon in line at pitches of 21.2 μm in the main scanning direction. The 15,000 OLEDs 201 are divided into 150 light-emitting blocks each consisting of 100 OLEDs 201.

A substrate surface of the TFT substrate 300 on which the OLEDs 201 are arranged is a sealing region to which the sealing plate 301 is attached with a spacer frame 303 sandwiched therebetween. This seals the sealing region with dry nitrogen or the like sealed therein so as not to be exposed to ambient air. Note that a moisture absorbent may be further sealed in the sealing region for absorption of moisture. Also, the sealing plate 301 may be for example a sealing glass or formed from material other than glass.

The source IC 302 is mounted on a region other than the sealing region of the TFT substrate 300. The luminance signal output unit 310 included in the control unit 112 inputs a digital luminance signal to the source IC 302 via a flexible wire 311. The source IC 302 converts the digital luminance signal to an analog luminance signal, and inputs the analog luminance signal to a drive circuit provided for each of the OLEDs 201. The drive circuit generates a driving current of the OLED 201 in accordance with the analog luminance signal.

Figure 4:
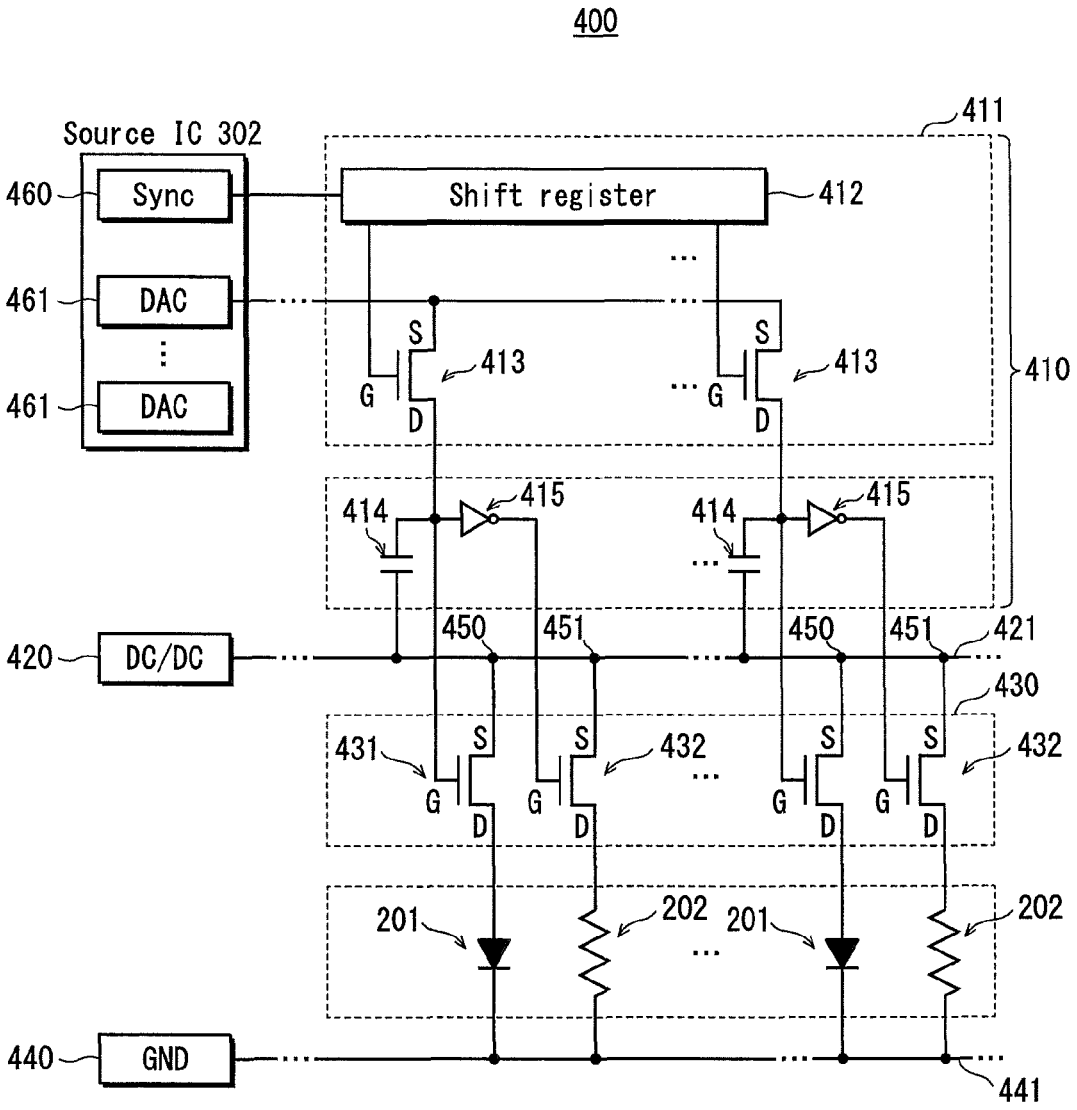
FIG. 4 shows the configuration of light-emitting block 400.

FIG. 4 shows the configuration of the light-emitting block 400. As shown in FIG. 4, a light-emitting block 400 includes a sample hold circuit (hereinafter, referred to as S/H circuit) 410, a drive circuit 430, and the OLEDs 201, and is connected with the source IC 302.

The source IC 302 includes a plurality of digital-to-analogue converter (DAC) circuits 461. The DAC circuits 461 one-to-one correspond to the light-emitting blocks 400, and each output an analog luminance signal to the S/H circuit 410 included in the corresponding light-emitting block 400 thereby to cause the OLEDs 201 included therein to emit light. In the present embodiment, the analog luminance signal has two types of potentials "H" and "L". When the analog luminance signal has the potential "H", the OLEDs 201 are turned on. When the analog luminance signal has the potential "L", the OLEDs 201 are turned off.

The DAC circuit 461 converts a digital luminance signal, which is received from the luminance signal output unit 310 included in the control unit 112, into an analog luminance signal, and outputs the analog luminance signal to the S/H circuit 410. The S/H circuit 410 is a circuit that switches, by a selector 411, between capacitors 414 that each hold therein the analog luminance signal for each of the OLEDs 201.

The selector 411 includes a shift register 412 and a switch 413 for each of the capacitors 414. The shift register 412 turns on the switches 413 in order one by one in synchronization with a pulse signal output from a synchronizing signal generation circuit 460 included in the source IC 302. The analog luminance signal, which is output from the DAC circuit 461, is held in the capacitor 414 via the switch 413 which is turned on.

The drive circuit 430 includes a thin-film transistor (hereinafter, referred to as OLED driving TFT) 431 and a thin-film transistor (hereinafter, referred to as dummy load driving TFT) 432. In the OLED driving TFT 431, a source terminal is connected with a power source wiring 421 to receive a current supplied from a DC/DC converter 420. Also, a gate terminal is connected with one of terminals of the corresponding capacitor 414. The other terminal of the capacitor 414 is connected with the power source wiring 421.

In the OLED driving TFT 431, a drain terminal is connected with an anode terminal of the OLED 201. When an analog luminance signal input to the gate terminal has the potential "H", the OLED driving TFT 431 turns on the OLED 201. When the input analog luminance signal has the potential "L", the OLED driving TFT 431 turns off the OLED 201. Hereinafter, the potential difference between the gate terminal and the source terminal in the thin-film transistor is referred to as a gate voltage $V_g$.

Figure 5:
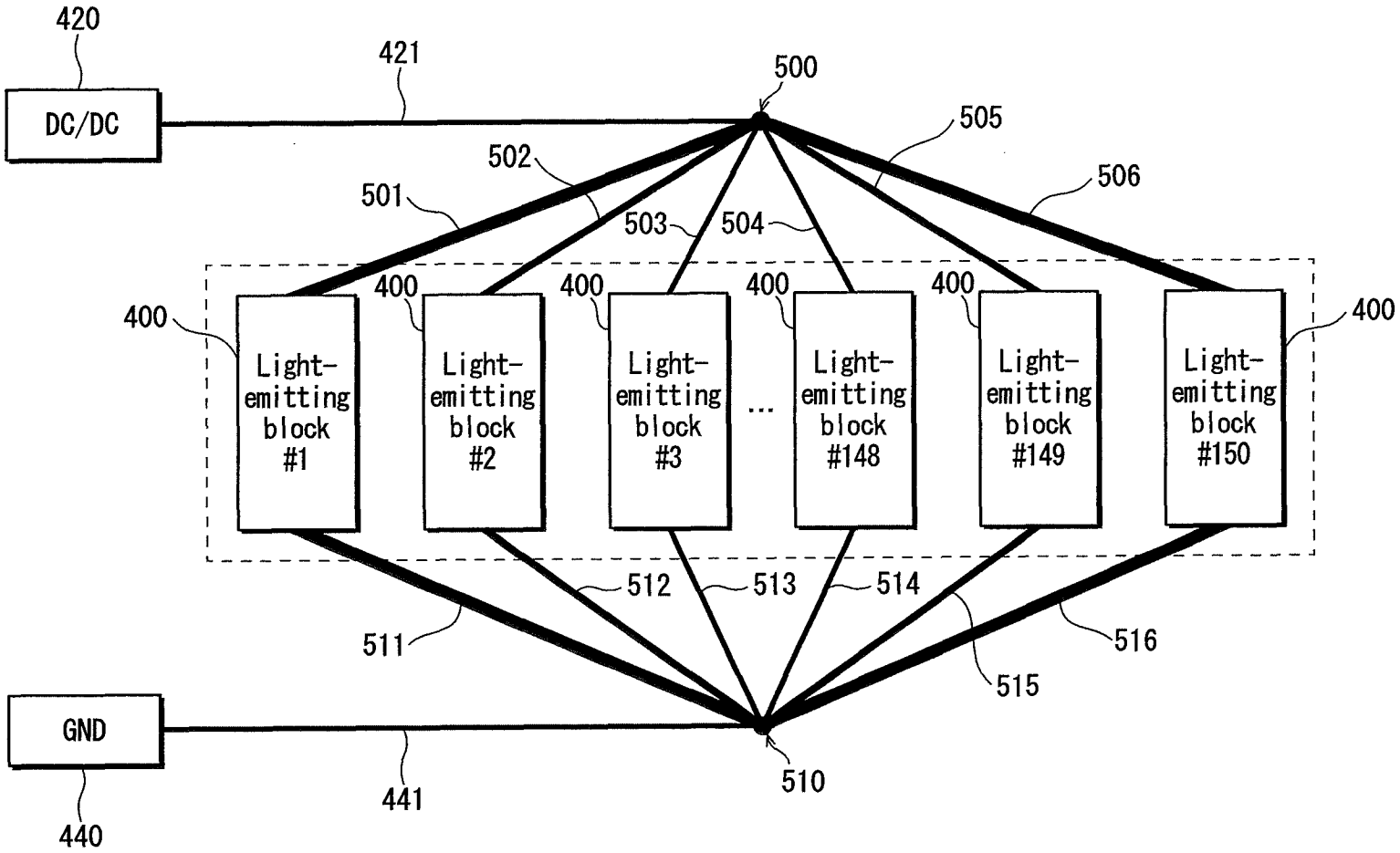
FIG. 5 is a pattern diagram showing a connection status of a power source wiring 421, a ground wiring 441, and the light-emitting blocks 400.
Figure 6:
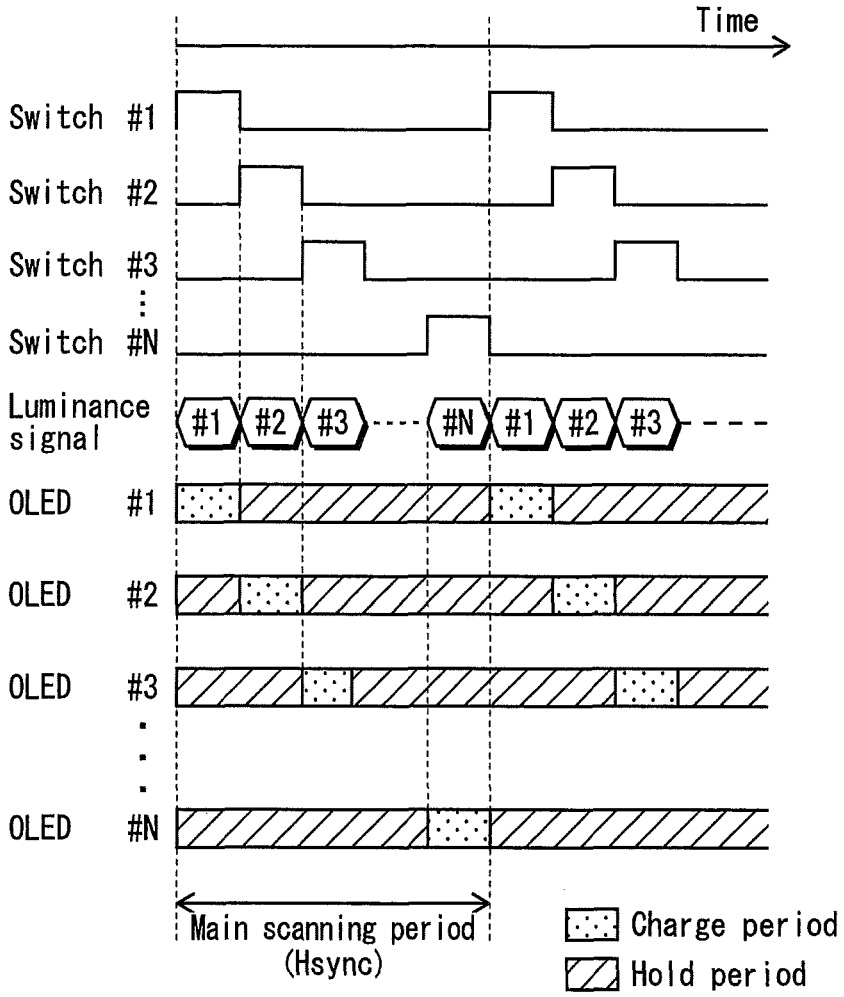
FIG. 6 is a timing chart showing rolling driving of the OLEDs 201.

A cathode terminal of the OLED 201 is connected with a ground wiring 441, and the ground wiring 441 is connected with a ground terminal 440. FIG. 5 is a pattern diagram showing a connection status of the power source wiring 421, the ground wiring 441, and the light-emitting blocks 400. As shown in FIG. 5, the power source wiring 421 branches, at a branch point 500, to 150 branch lines 501 to 506 each extending to one of the light-emitting blocks 400.

The branch lines 501 to 506 differ in wiring width from each other in accordance with the wiring length thereof. Specifically, the branch lines 501 to 506 are each formed such that a branch line, which has a longer wiring length from the branch point 500 to the light-emitting block 400, has a wider wiring width. This equalizes wiring impedance between the branch lines 501 to 506.

Similarly, the ground wiring 441 branches, at a branch point 510, to 150 branch lines 511 to 516 each extending to one of the light-emitting blocks 400. The branch lines 511 to 516 are also each formed such that a branch line, which has a longer wiring length from the branch point 510 to the light-emitting block 400, has a wider wiring width. This equalizes wiring impedance between the branch lines 501 to 516.

In the dummy load driving TFT 432, a gate terminal is connected with the one of the terminals of the capacitor 414 via an inverter 415. The one terminal of the capacitor 414, which is connected with the gate terminal, is a terminal that is not connected with the power source wiring 421. Also, a drain terminal is connected with a dummy load 202. In the present embodiment, the dummy load 202 is an electrical resistance element having an impedance equal to that of the OLED 201.

The inverter 415 inverts the analog luminance signal for output. In other words, when the analog luminance signal has the potential "H", the inverter 415 outputs the analog luminance signal having the potential "L", and when the analog luminance signal has the potential "L", the inverter 415 outputs the analog luminance signal having the potential "H". Accordingly, only while the OLED 201 is turned off, the dummy load driving TFT 431 flows a current to the dummy load 202. The dummy load 202 is further connected with the ground wiring 441, and the current, which flows through the dummy load 202, flows to the ground terminal 440.

By performing the control in this way, a current flows to the dummy load 202 while the OLED 201 is turned off. This suppresses unevenness in power consumption between pixels irrespective of whether the OLEDs 201 are each turned on or turned off. Accordingly, an amount of electrical power consumption is uniform between the light-emitting blocks 400 irrespective of the type of image data.

Also, since the branch lines of the power source wiring 421 are equal in impedance to each other, the branch lines are equal in voltage drop to each other during power supply. Furthermore, since a voltage of the analog luminance signal, which is output from the DAC circuit 461, does not drop due to a wiring resistance, the voltage is always uniform and stable between the light-emitting blocks 400.

Moreover, the control unit 112 manages a history of light emission for each of the OLEDs 201 by a dot counter which is described later. In order to equalize the respective count values of the pixels so as to be equal to the largest count value, the control unit 112 turns on the remaining OLEDs 201 other than the OLED 201 having the largest count value during no-printing period thereby to increase each of the count values other than the largest count value.

By performing the control in this way, it is possible to uniformize the degree of decrease in light amount between the OLEDs 201, thereby uniformizing a current amount necessary for light emission between the OLEDs 201.

The OLEDs 201 are rolling-driven in this way. In other words, the OLEDs 201 each change the light amount during a charge period in which the corresponding capacitor 414 is charged by an analog luminance signal, and is turned on with the light amount in accordance with the analog luminance signal during a hold period in which the capacitor 414 holds therein the analog luminance signal.

[3] Control Operations on DC/DC Converter 420

Next, description is given on control operations on the DC/DC converter 420 performed by the control unit 112.

Figure 7:
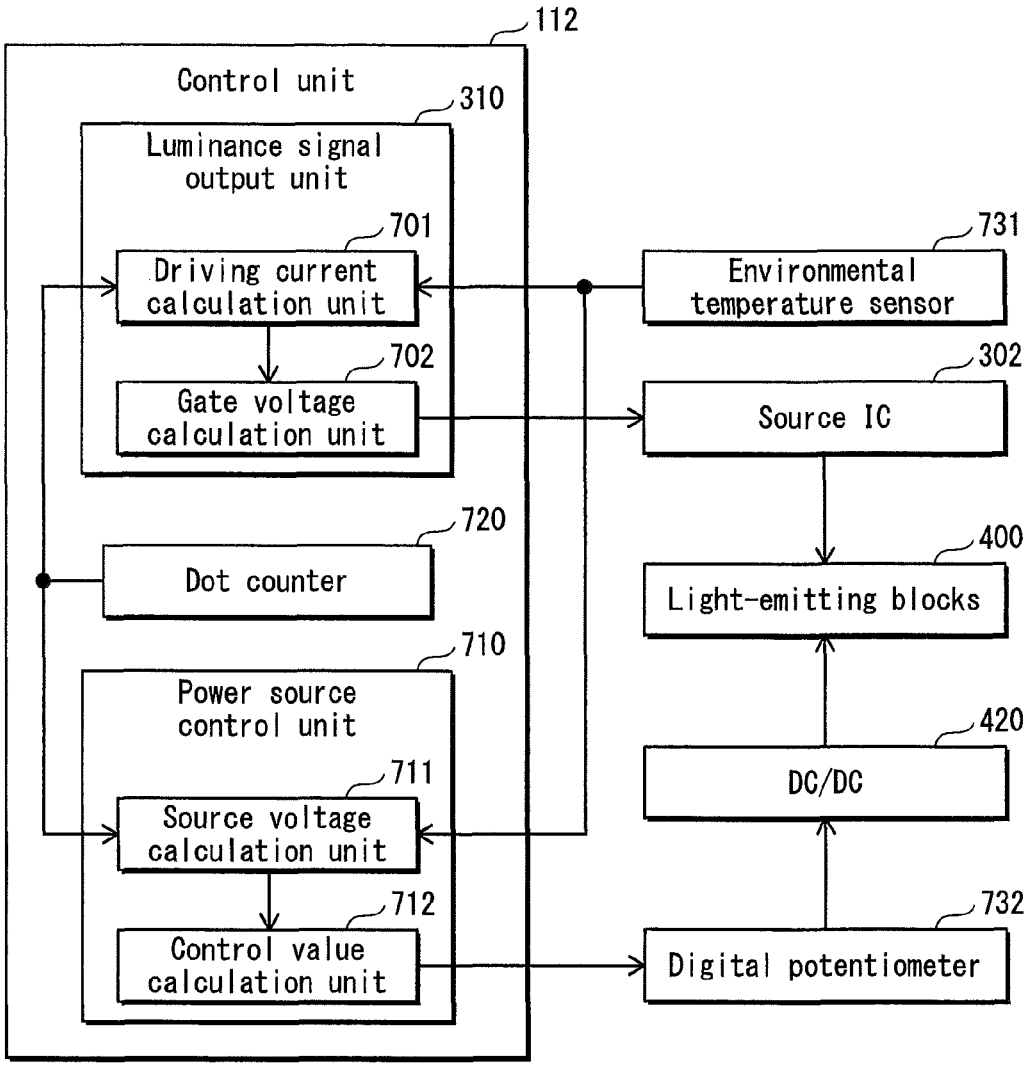
FIG. 7 is a block diagram showing the main configuration of a control unit 112.

FIG. 7 is a block diagram showing the main configuration of the control unit 112. As shown in FIG. 7, the control unit 112 includes a power source control unit 710 and a dot counter 720, in addition to the above-described luminance signal output unit 310. The dot counter 720 is a counter that counts the number of times of turning on each of the OLEDs 201. A count value C of the dot counter 720 indicates an accumulated light-emitting period for each of the OLEDs 201.

The control unit 112 is connected with an environmental temperature sensor 731. The environmental temperature sensor 731 detects ambient temperature of each of the OLEDs 201 as environmental temperature T of the OLED 201.

(3-1) Luminance Signal Output Unit 310

The luminance signal output unit 310 includes a driving current calculation unit 701 and a gate voltage calculation unit 702.

The driving current calculation unit 701 calculates a driving current amount I necessary for turning on each of the OLEDs 201. In the present embodiment, the driving current calculation unit 701 stores therein an approximate function f for each environmental temperature T (for example for each 2 degrees of Celsius). The approximate function f has the count value C for each of the OLEDs 201 as a parameter. Also, in order to compensate the unevenness in initial luminescence properties between the OLEDs 201, the driving current calculation unit 701 stores therein a compensation current amount $I_{initial}$ that can compensate the largest unevenness in initial light-emitting properties between the OLEDs 201.

The driving current calculation unit 701 calculates the driving current amount I to be flowed to each of the OLEDs 201 with use of the approximate function f and the compensation current amount $I_{initial}$. In calculation of the driving current amount I, the driving current calculation unit 701 reads the count value C of the OLED 201 from the dot counter 720, and also reads the environmental temperature T from the environmental temperature sensor 731, and thereby to select the approximate function f corresponding to the read environmental temperature T.

The count value C is substituted into the approximate function f selected in accordance with the environmental temperature T. Furthermore, the compensation current amount $I_{initial}$ is added. As a result, the driving current amount I of the OLED 201 is calculated.

Figure 8:
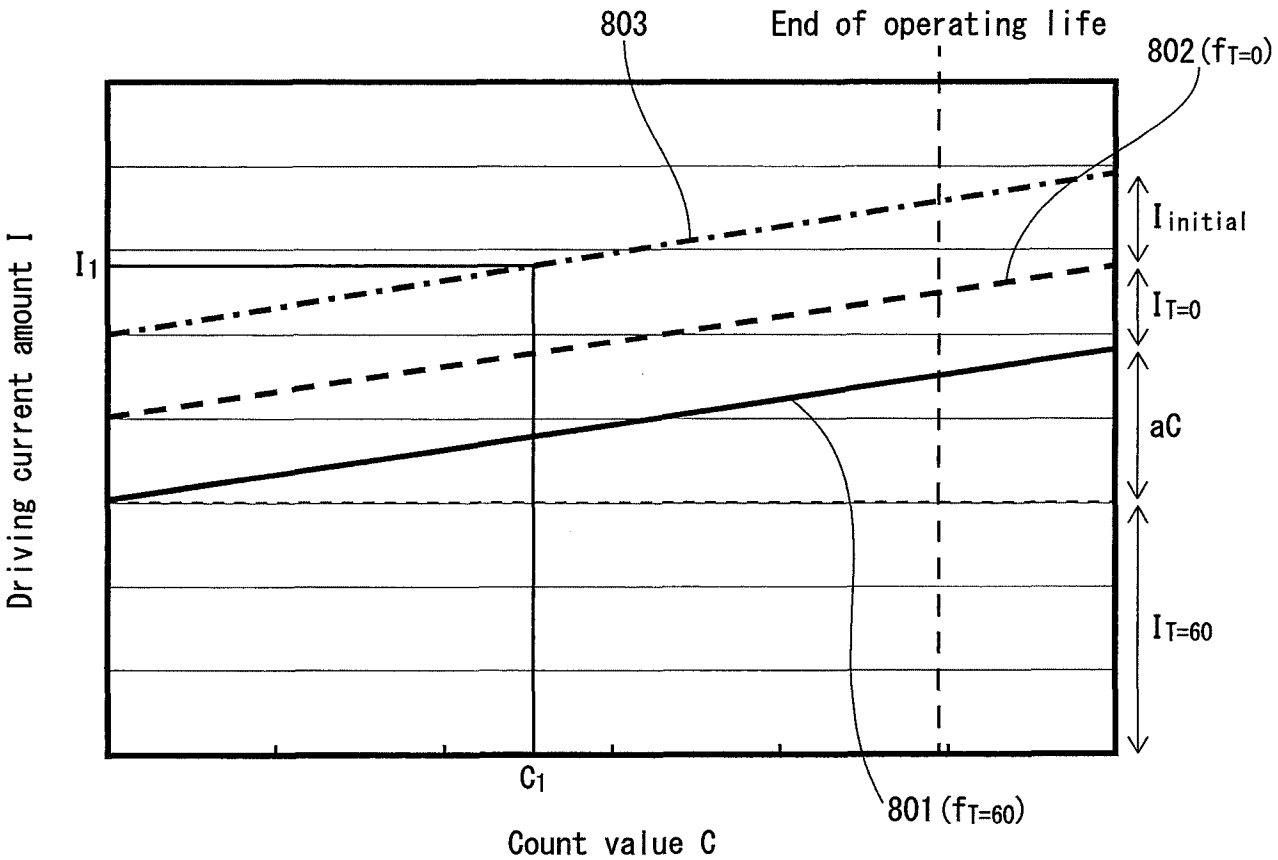
FIG. 8 shows graphs illustrating a relation between a count value C and a driving current amount I.

FIG. 8 shows graphs illustrating a relation between the count value C and the driving current amount I for obtaining a certain reference light amount. In FIG. 8, the horizontal axis of the graph represents the count value C, and the vertical axis represents the driving current amount I. When the environmental temperature is 60 degrees of Celsius or lower, the driving current amount I necessary for turning on the OLED 201 increases in proportion to the count value C indicating an accumulated light-emitting period of the OLED 201, as shown by a solid line graph 801.

When the environmental temperature decreases from 60 degrees of Celsius to 0 degree of Celsius, the driving current amount I necessary for turning on the OLED 201 increases by a constant amount of driving current components $I_{T=0}$ corresponding to the difference from the solid line graph 801 to a dashed line graph 802, dependent only on the environmental temperature irrespective of the count value C.

The driving current amount I is further increased by only the compensation current amount $I_{initial}$, and as a result the driving current amount I necessary for turning on the OLED 201 is calculated. The above description is summarized that the driving current amount I necessary for turning on the OLED 201 at an environmental temperature of 60 degrees of Celsius can be approximated by a linear function $f_{T=60}$ of the count value C of the OLED 201 (the graph 801 in FIG. 8).

$$f_{T=60}(C)=aC+I_{T=60} \tag{1}$$

In Equation (1), a is a proportionality factor specified by experiments, and $I_{T=60}$ is a driving current amount necessary for turning on the OLED 201 when the count value C is zero (before shipment).

An approximate function $f_{T=0}$ at an environmental temperature of 0 degree of Celsius is as follows (the graph 802 in FIG. 8).

$$f_{T=0}(C)=f_{T=60}(C)+I_{T=0} \tag{2}$$

Substitution of Equation (1) into Equation (2) results in as follows.

$$f_{T=0}(C)=aC+I_{T=60}+I_{T=0} \tag{3}$$

Furthermore, the compensation current amount $I_{initial}$ for compensating the unevenness in initial light-emitting properties is added, and as a result the driving current amount I to be flowed to the OLED 201 is calculated (the graph 803 in FIG. 8).

$$I=f_{T=0}(C)+I_{initial} \tag{4}$$

Substitution of Equation (3) into Equation (4) results in as follows.

$$I=aC+I_{T=60}+I_{T=0}+I_{initial} \tag{5}$$

Note that the driving current calculation unit 701 may store therein the compensation current amount $I_{initial}$ as an initial characteristic value. Also, the driving current calculation unit 701 may store therein data of the proportionality factor a and the driving current amounts $I_{T=60}$ and $I_{T=0}$ for example for each 2 degrees of Celsius.

The use of the approximate function f allows calculation of the driving current amount I. For example, when the count value is $C_1$ at an environmental temperature of 0 degree of Celsius, the driving current amount I is calculated as follows.

$$I_1=f_{T=0}(C_1)+I_{initial} \tag{6}$$

The driving current amount I calculated in this way is input to the gate voltage calculation unit 702. The gate voltage calculation unit 702 stores therein a look up table (LUT) for calculating a gate voltage $V_g$ "H" to be applied to the OLED driving TFT 431 in accordance with the driving current amount I.

The gate voltage calculation unit 702 generates a digital luminance signal from the gate voltage $V_g$ which is calculated with reference to the LUT, and outputs the generated digital luminance signal to the source IC 302. The source IC 302 converts the digital luminance signal to an analog luminance signal, and outputs the analog luminance signal to the light-emitting block 400 by the rolling drive described above.

The gate voltage calculation unit 702 generates a digital luminance signal by calculating the gate voltage $V_g$ from the input driving current amount I. The generated digital luminance signal is input to the source IC 302.

(3-2) Power Source Control Unit 710

The power source control unit 710 includes a source voltage calculation unit 711 and a control value calculation unit 712, and controls an output voltage V of the DC/DC converter 420.

The source voltage calculation unit 711 stores therein an approximate function g for each environmental temperature T (for example for each 2 degrees of Celsius). The approximate function g is an approximate function for calculating a necessary source voltage, and has the count value C of the dot counter 720 as a parameter. Also, the source voltage calculation unit 711 stores therein a compensation voltage $V_{initial}$ for compensating the unevenness in initial light-emitting properties between the OLEDs 201.

Figure 9:
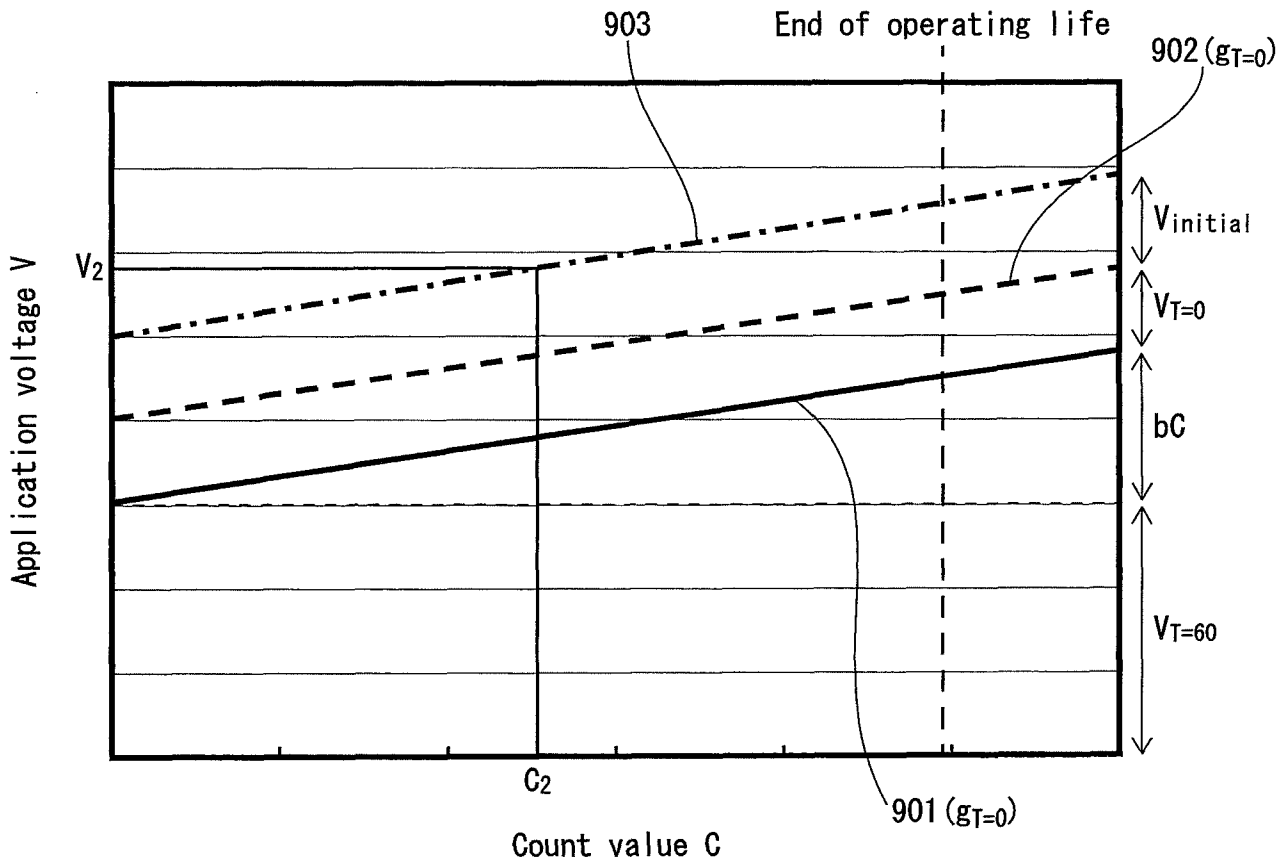
FIG. 9 shows graphs illustrating a relation between the count value C and an application voltage V.

FIG. 9 shows graphs illustrating a relation between the count value C and the application voltage V. In FIG. 9, the horizontal axis represents the count value C, and the vertical axis represents the application voltage V. In the present embodiment, an application voltage V necessary for turning on the OLED 201 at an environmental temperature of 60 degrees of Celsius is calculated with use of a linear function $g_{T=60}$ of the count value C (a graph 901 in FIG. 9).

$$g_{T=60}(C)=bC+V_{T=60} \tag{7}$$

In Equation (7), b is a proportionality factor specified by experiments, and $V_{T=60}$ is an application voltage necessary for turning on the OLED 201 when the count value C is zero (before shipment).

An approximate function $g_{T=0}$ at an environmental temperature of 0 degree of Celsius is as follows (a graph 902 in FIG. 9).

$$g_{T=0}(C)=g_{T=60}(C)+V_{T=0} \tag{8}$$

Substitution of Equation (7) into Equation (8) results in as follows.

$$g_{T=0}(C)=bC+V_{T=60}+V_{T=0} \tag{9}$$

Furthermore, the compensation voltage $V_{initial}$ for compensating the unevenness in initial light-emitting properties is added, and a source-drain voltage $V_{ds1}$ necessary for operating the OLED driving TFT 431 is added. As a result, an application voltage V to be applied to the OLED 201 is calculated (the graph 903 in FIG. 9).

$$V=g_{T=0}(C)+V_{initial}+V_{ds1} \tag{10}$$

Substitution of Equation (9) into Equation (10) results in as follows.

$$V=bC+V_{T=60}+V_{T=0}+V_{initial}+V_{ds1} \tag{11}$$

Note that the source voltage calculation unit 711 may store therein the compensation voltage $V_{initial}$ as an initial characteristic value. Also, the source voltage calculation unit 711 may store therein data of the proportionality factor b and the application voltages $V_{T=60}$ and $V_{T=0}$ for example for each 2 degrees of Celsius.

The use of the approximate function g allows calculation of the application voltage V. For example, when the count value is $C_2$ at an environmental temperature of 0 degree of Celsius, the application voltage V is calculated as follows.

$$V_2=g_{T=0}(C_2)+V_{initial}+V_{ds1} \quad (12)$$

The control value calculation unit 711 calculates a control value with reference to the LUT from the source voltage calculated by the source voltage calculation unit 711, and inputs the calculated control value to a digital potentiometer 732. The digital potentiometer 732 is a variable resistance device capable of setting a predetermined electrical resistance value by inputting a digital value, and is connected with a reference terminal of the DC/DC converter 420.

The DC/DC converter 420 is a voltage converter that, upon receiving DC electrical power supplied from the power source device of the image forming apparatus 1, outputs DC electrical power of designated voltage. The power source device of the image forming apparatus 1 receives AC electrical power supplied from a commercial power source, and supplies electrical power to the devices such as the DC/DC converter 420 included in the image forming apparatus 1.

The DC/DC converter 420 outputs a voltage in accordance with the resistance of a reference resistor that is connected with the reference terminal. Accordingly, the voltage having the source voltage calculated by the source voltage calculation unit 711 is output.

(3-3) Comparison with Conventional Art

The following compares the present embodiment with the conventional art in terms of magnitude of a voltage applied to the OLED driving TFTs 431.

Figure 10:
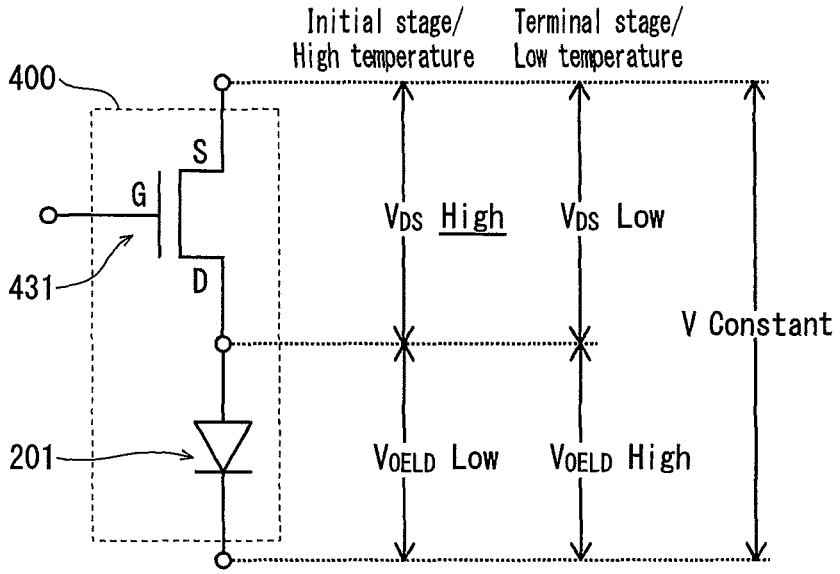
FIG. 10 Conventional art
Figure 10:
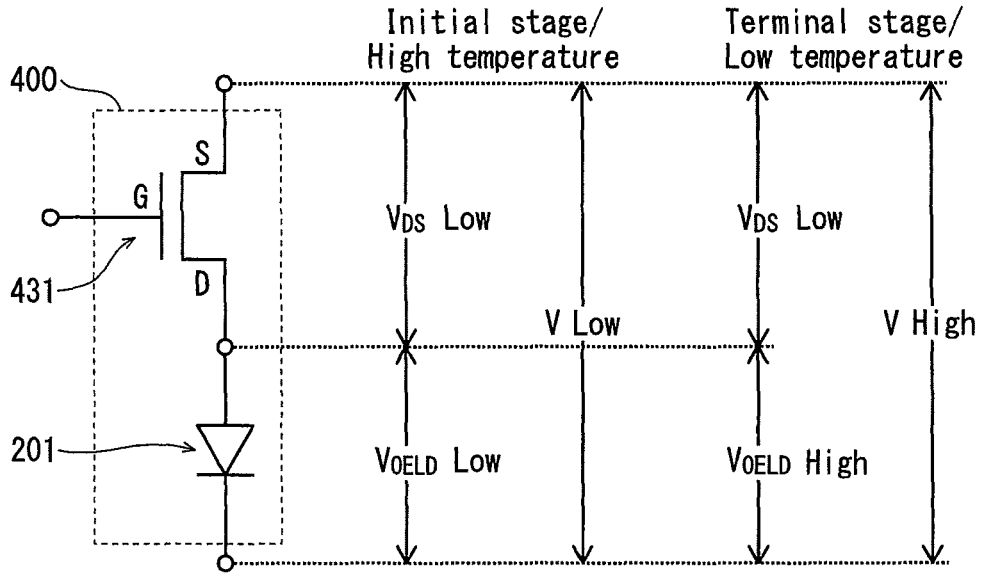
FIG. 10 Conventional art

FIG. 10 shows magnitude of respective divided voltages of the OLED driving TFT 431 and the OLED 201 that are divided from a source voltage applied to the light-emitting block 400 while the OLED 201 is turned on.

According to the conventional art as shown in FIG. 10, the source voltage V to be applied to the light-emitting block 400 is constant irrespective of the length of the accumulated light-emitting period and the level of the environmental temperature. When the accumulated light-emitting period is short and/or when the environmental temperature is high, a low driving current amount I is necessary for turning on the OLED 201. When the accumulated light-emitting period is long and/or when the environmental temperature is low on the other hand, a higher driving current amount I is necessary for turning on the OLED 201.

For this reason, the source voltage V is set high in the conventional art in order to supply a driving current amount I necessary for the case when the accumulated light-emitting period is long and/or when the environmental temperature is low. As a result, since when accumulated light-emitting period is short and/or when the environmental temperature is high, voltage drop $V_{OLED}$ is less, divided voltage to be applied to the OLED driving TFT 431, that is, the source-drain voltage $V_{DS}$ is large (for example 10 V).

According to the present embodiment compared with this, when the accumulated light-emitting period is short and/or when the environmental temperature is high, the source voltage V is set low. This suppresses the divided voltage $V_{DS}$ to low even when the voltage drop $V_{OLED}$ of the OLED 201 is low. In other words, it is unnecessary to take into consideration of variation of the voltage drop $V_{OLED}$ of the OLED 201, and only a voltage necessary for operating the OLED driving TFT 431 is applied.

Figure 11:
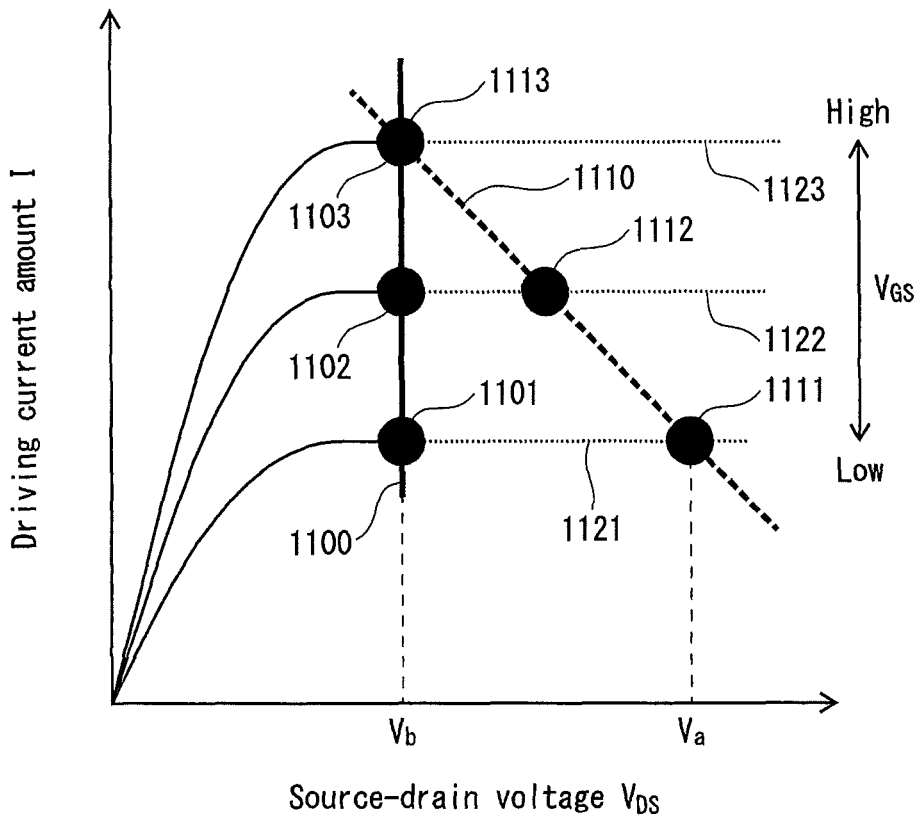
FIG. 11 shows graphs of a relation between a source-drain voltage $V_{DS}$ and a source-drain current (driving current) amount I in a usable region (saturated region) of the OLED driving TFT 431.

FIG. 11 shows graphs of a relation between a source-drain voltage $V_{DS}$ and a source-drain current (driving current) amount I in a usable region (saturated region) of the OLED driving TFT 431. In FIG. 11, a solid line graph 1100 expresses the present embodiment, and a dashed line graph 1110 expresses the conventional art. Also, dashed line graphs 1121 to 1123 each express a characteristic curve for each gate voltage $V_g$ of the OLED driving TFT 431.

According to the conventional art as shown in FIG. 11, as the accumulated light-emitting period of the OLED 201 increases, the source-drain voltage $V_{DS}$ of the OLED driving TFT 431 dynamically varies from $V_a$ to $V_b$. At this time, an operating point of the OLED driving TFT 431 travels from a point 1111 to a point 1113 through a point 1112.

According to the present embodiment compared with this, control of the source voltage V keeps the source-drain voltage $V_{DS}$ to $V_b$ irrespective of the length of the accumulated light-emitting period of the OLED 201. At this time, the operating point travels from a point 1100 to a point 1103 through a point 1102. Therefore, the present embodiment allows flowing of the driving current I to the OLED 201 similarly to the conventional art.

Figure 12:
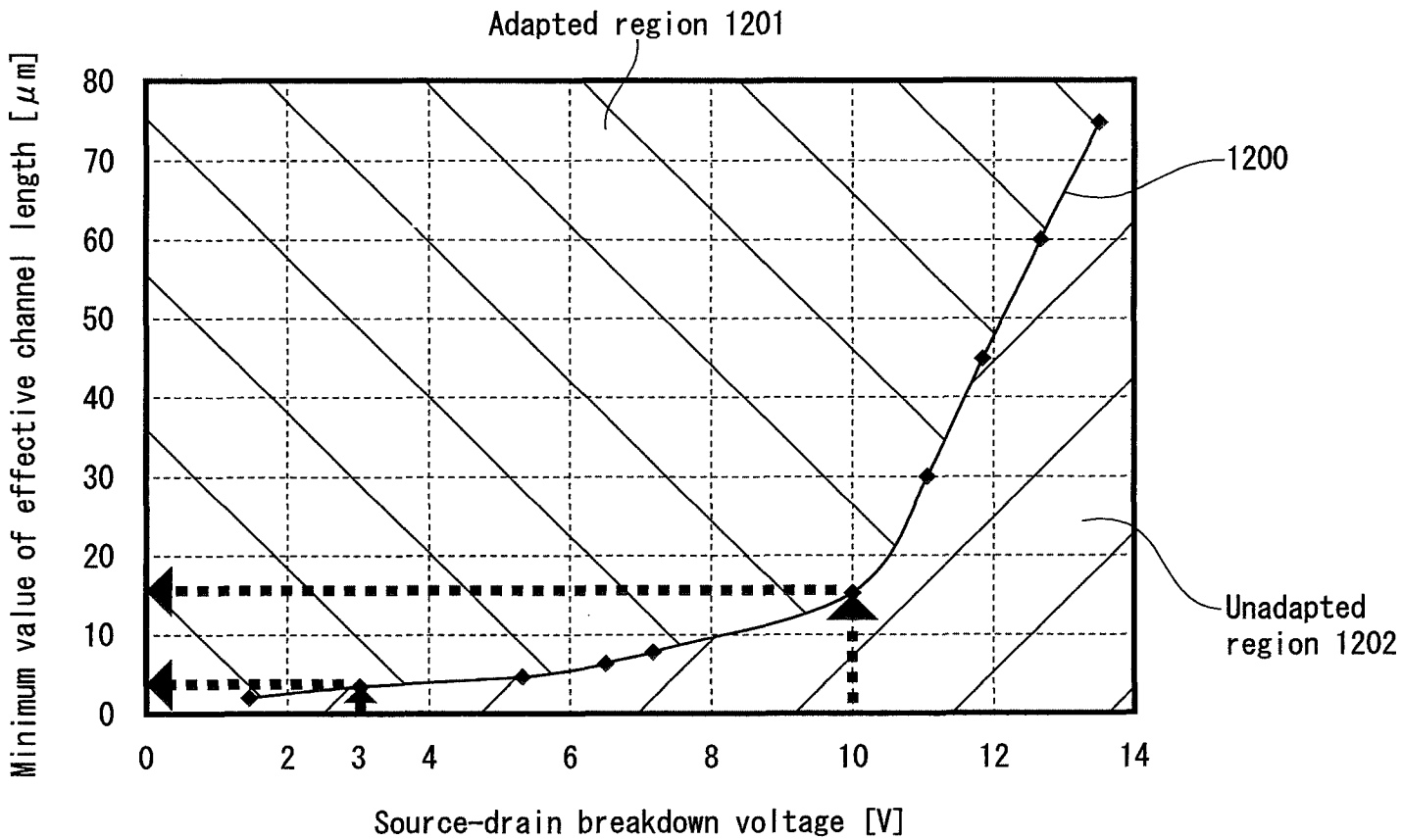
FIG. 12 shows graphs of a relation between a source-drain breakdown voltage and the minimum value of effective channel length of a TFT.
Figure 13:
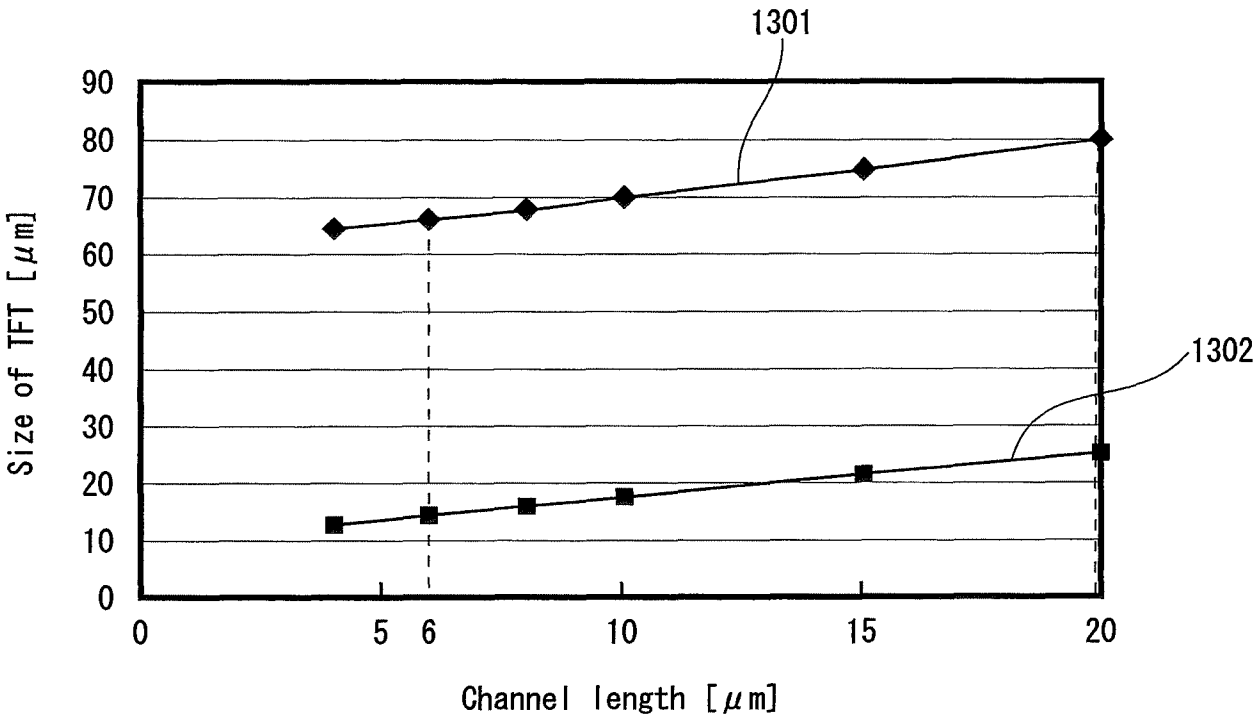
FIG. 13 shows graphs of a relation between channel length and size of the TFT.

According to the present embodiment, in the case where only a voltage of 3 V necessary for operating the OLED driving TFT 431 is applied (FIG. 15), it is possible to achieve a sufficient breakdown voltage only with an effective channel length of 3 μm or longer (FIG. 12). A geometric margin is added to the effective channel length thereby to obtain 6 μm that is a channel length of the OLED driving TFT 431. The OLED driving TFT 431 having the channel length of 6 μm has a size of 66 μm in the longitudinal direction and 13 μm in the width direction (FIG. 13).

In this way, a low breakdown voltage of the OLED driving TFT 431 is necessary by suppressing the application voltage of the OLED driving TFT 431, and therefore this achieves the size reduction of the OLED driving TFT 431.

Figure 14:
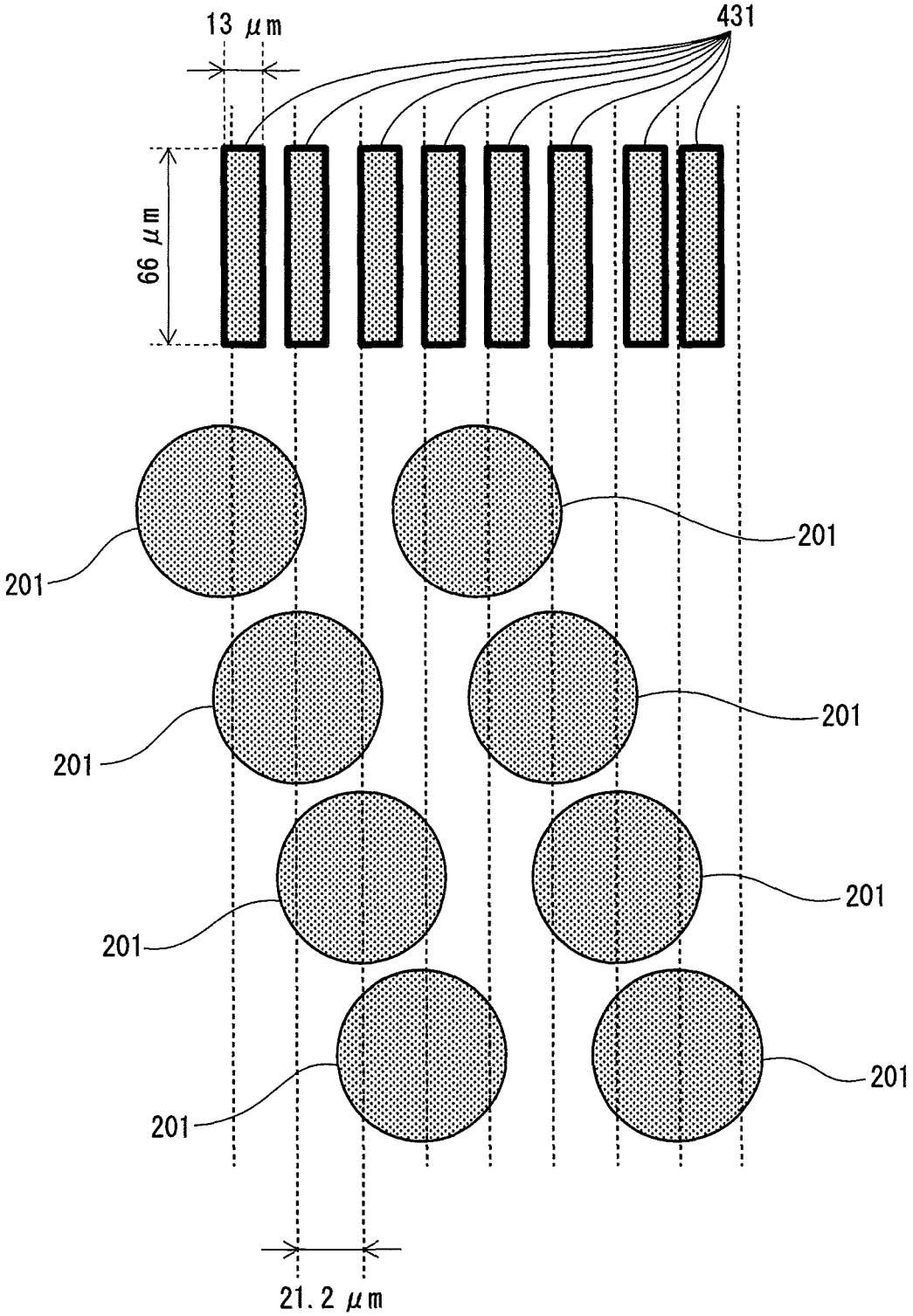
FIG. 14 shows arrangement of OLED driving TFTs 431 relating to the present embodiment.
Figure 16:
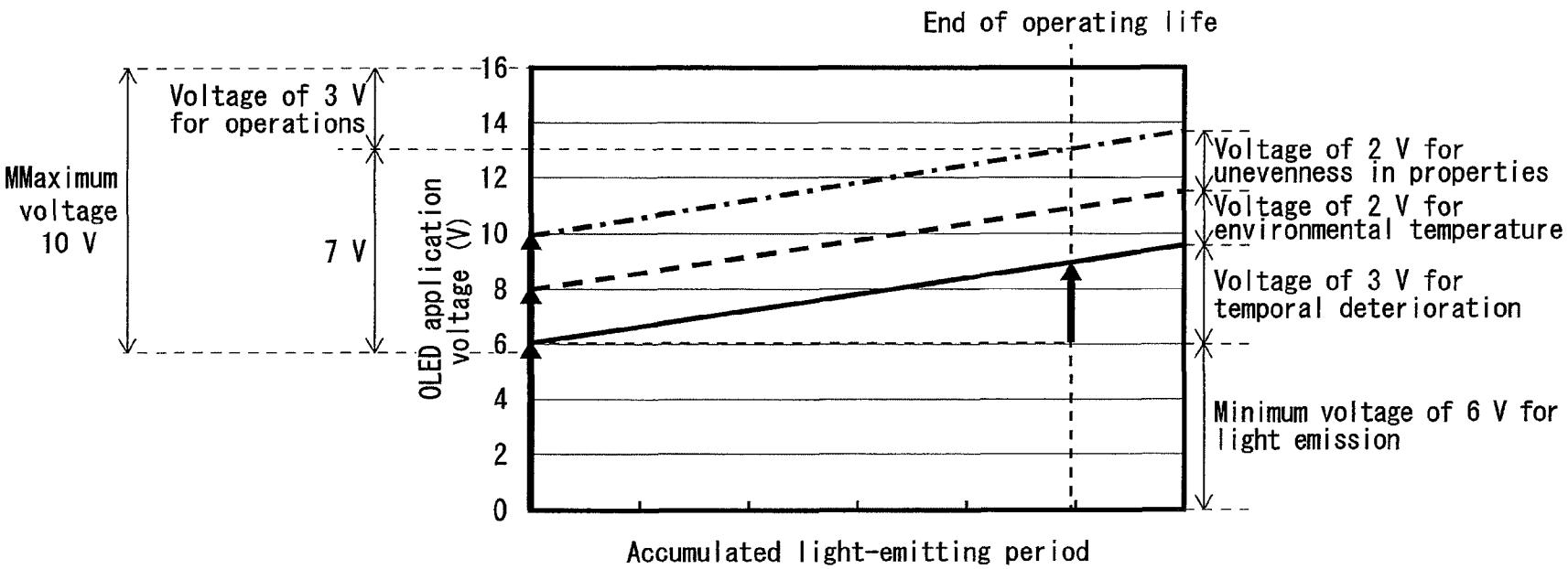
FIG. 16 shows graphs of the details of the maximum value of the source-drain voltage of the TFTs.
Figure 17:
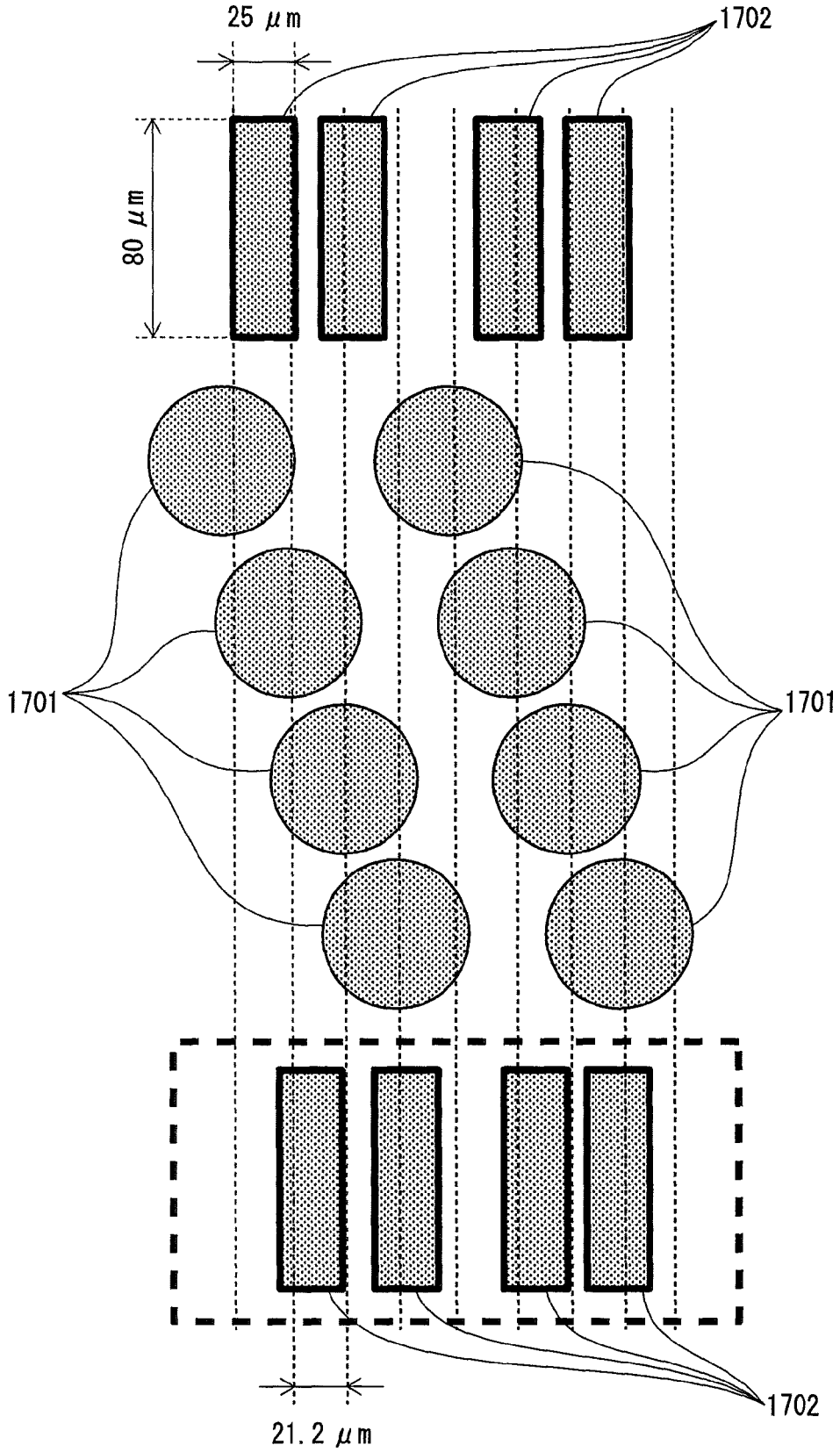
FIG. 17 shows arrangement estimated with respect to OLEDs and TFTs relating to the conventional art.

Although an optical PH having a resolution of 1200 dpi includes pixels (OLEDs 1701) that are need to be arranged at pitches of 21.2 μm in the main scanning direction, the OLED driving TFTs 431 according to the present embodiment each have the size of 13 μm in the width direction, and therefore it is possible to arrange all the OLED driving TFTs 431 in a single row in the main scanning direction as shown in FIG. 14. Therefore, compared with the conventional art according to which the OLED driving TFTs 431 are arranged in the main scanning direction in two separate rows, it is possible to reduce the size of the TFT substrate 300 in the sub scanning direction, thereby achieving the size reduction of the optical PH 123.

[4] Modifications

Although the present invention has been described based on the above embodiment, the present invention is not of course limited to the above embodiment. The present invention may include the following modification examples.

(1) In the above embodiment, the description has been given on the case where the approximate functions f and g are used for calculating the driving current amount I and the application voltage V, respectively. However, the present invention is of course not limited to this, and an LUT may be used for calculating the driving current amount I and the application voltage V, instead of the approximate functions. This LUT is a table showing the correspondence between a pair of the accumulated light-emitting period and the environmental temperature and a pair of the driving current amount I and the application voltage V.

Also, the proportionality factors a and b used for the approximate functions each may differ for each environmental temperature, and should desirably be set to an appropriate value by experiments.

(2) In the above embodiment, the description has been given on the case where the source voltage V is adjusted by adjusting the electrical resistance of the digital potentiometer, which is connected with the DC/DC converter 420. However, the present invention is of course not limited to this, and it is also possible to exhibit the effects of the present invention by using other means for adjusting the source voltage V.

(3) In the above embodiment, the description has been given on the case where the branch lines 501 to 506 are each formed such that a branch line, which has a longer wiring length from the branch point 500 to the light-emitting block 400, has a wider wiring width. However, the present invention is of course not limited to this, and the following may be employed instead.

Specifically, the wiring impedance may be equalized by uniformizing the wiring length between the branch lines 501 to 506. Here, in the case where a linear distance between the both ends of the branch line is short, it is possible to increase the wiring length by employing a meander line in which a wiring pattern is meandered.

Alternatively, the wiring impedance may be equalized between the branch lines 501 to 506 by adjusting both the wiring width and the wiring length.

(4) In the above embodiment, the description has been given with use of an example where the dummy load 202 is an electrical resistance element. However, the present invention is of course not limited to this, and an impedance element other than an electrical resistance element may be used as the dummy load 202.

Also, even in the case where the optical PH has the configuration in which the dummy load 202, the dummy load driving TFT 432, and the inverter 415 are omitted, it is possible to exhibit the effects of the present invention by controlling the source voltage V as described above.

(5) In the above embodiment, the description has been given on the case where the driving current of the OLED 201 is controlled by controlling the gate voltage $V_g$ of the OLED driving TFT 431. This control of the gate voltage $V_g$ may be performed for example by connecting the gate terminal of the OLED driving TFT 431 with an ammeter circuit that is composed of a variable resistance element that is connected with a constant current source, and controlling a variable resistance of the variable resistance element.

(6) In the above embodiment, the comparison has been made between the present invention and the conventional art according to which the OLED driving TFTs 431 are arranged in two rows. However, the present invention is of course not limited to this. Even in the case where the OLED driving TFTs 431 need to be arranged in three or more rows according to the conventional art due to a high resolution of images to be formed and a narrow pixel pitch, application of the present invention allows reduction of the number of rows of the OLED driving TFTs 431, thereby achieving the size reduction of the TFT substrate 300.

(7) In the above embodiment, the description has been given on the case where the gate voltage $V_g$ has two values of "H" and "L". However, the present invention is of course not limited to this, and multiple-tone images may be formed by the gate voltage $V_g$ having three or more values. This case exhibits the same effects of the present invention.

(8) In the above embodiment, the description has been given with use of an example where the image forming apparatus is a tandem-type color multifunction machine. However, the present invention is of course not limited to this, and the image forming apparatus may be a color multifunction machine that is not of a tandem-type or a monochrome multifunction machine. Also, the same effects can also be achieved by applying the present invention to a single-function device such as a printer device, a copy device including a scanner, and a facsimile device having a communication function.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

The invention claimed is:

1. An optical print head that performs optical writing onto a target, the optical print head comprising:

a plurality of current-driven light-emitting elements that are arranged in rows in a predetermined direction;

a plurality of driving transistors that are each electrically series-connected with the light-emitting elements in one-to-one correspondence, and each structured to supply a driving current to a corresponding one of the light-emitting elements;

a current control unit structured to control, for each of the light-emitting elements, an amount of the driving current in accordance with variation in light-emitting properties of the light-emitting element, the light-emitting properties indicating a relation between the amount of the driving current and an amount of light emitted by the light-emitting element;

structured to, upon receiving electrical power supplied from an external power source, apply an application voltage to a source or a drain of each of the plurality of driving transistors;

a voltage control unit structured to vary the application voltage such that the application voltage is repeatedly increased as the amount of the driving current increases.

2. The optical print head of claim 1, further comprising a count unit structured to count, for each of the light-emitting elements, an accumulated light-emitting period that is a parameter for varying the light-emitting properties, wherein the current control unit is structured to increase the amount of the driving current as the accumulated light-emitting period increases.

3. The optical print head of claim 1, further comprising a detection unit structured to detect, for each of the light-emitting elements, environmental temperature that is a parameter for varying the light-emitting properties, wherein the current control unit is structured to increase the amount of the driving current as the environmental temperature decreases.

4. The optical print head of claim 1, wherein the voltage control unit is structured to determine magnitude of the application voltage based on one of the light-emitting elements that needs the highest amount of the driving current necessary for the light-emitting elements to emit light of a uniform amount.

5. The optical print head of claim 1, further comprising an ammeter comprising a constant current source and a variable resistance element, and structured to output a voltage corresponding to a variable resistance of the variable resistance element, wherein the current control unit is structured to control the amount of the driving current by controlling the variable resistance.

6. The optical print head of claim 1, further comprising a look up table (LUT) storage unit structured to store therein, for each of the light-emitting elements, an LUT showing correspondence between a parameter for varying the light-emitting properties and the amount of the driving current, wherein the current control unit is structured to control the amount of the driving current with reference to the LUT.

7. The optical print head of claim 1, further comprising a function storage unit structured to store therein, for each of the light-emitting elements, a function for calculating the amount of the driving current from a parameter for varying the light-emitting properties, wherein the current control unit is structured to calculate the amount of the driving current with use of the function.

8. The optical print head of claim 1, wherein the driving transistors are each a thin-film transistor.

9. The optical print head of claim 1, wherein the light-emitting elements are each an organic light-emitting diode.

10. The optical print head of claim 1, wherein the light-emitting elements and the driving transistors are formed on the same substrate.

11. An image forming apparatus that includes an optical print head that performs optical writing onto a target, the optical print head comprising:

a plurality of current-driven light-emitting elements that are arranged in rows in a predetermined direction;

a plurality of driving transistors that are each electrically series-connected with the light-emitting elements in one-to-one correspondence, and each structured to supply a driving current to a corresponding one of the light-emitting elements;

a current control unit structured to control, for each of the light-emitting elements, an amount of the driving current in accordance with variation in light-emitting properties of the light-emitting element, the light-emitting properties indicating a relation between the amount of the driving current and an amount of light emitted by the light-emitting element;

structured to, upon receiving electrical power supplied from an external power source, apply an application voltage to a source or a drain of each of the plurality of driving transistors; and a voltage control unit structured to vary the application voltage such that the application voltage is repeatedly increased as the amount of the driving current increases.

12. The image forming apparatus of claim 11, wherein the optical print head further comprises a count unit structured to count, for each of the light-emitting elements, an accumulated light-emitting period that is a parameter for varying the light-emitting properties, and the current control unit is structured to increase the amount of the driving current as the accumulated light-emitting period increases.

13. The image forming apparatus of claim 11, wherein the optical print head further comprises a detection unit structured to detect, for each of the light-emitting elements, environmental temperature that is a parameter for varying the light-emitting properties, and the current control unit is structured to increase the amount of the driving current as the environmental temperature decreases.

14. The image forming apparatus of claim 11, wherein the voltage control unit is structured to determine magnitude of the application voltage based on one of the light-emitting elements that needs the highest amount of the driving current necessary for the light-emitting elements to emit light of a uniform amount.

15. The image forming apparatus of claim 11, wherein the optical print head further comprises an ammeter comprising a constant current source and a variable resistance element, and outputs a voltage corresponding to a variable resistance of the variable resistance element, and the current control unit is structured to control the amount of the driving current by controlling the variable resistance.

16. The image forming apparatus of claim 11, wherein the optical print head further comprises a look up table (LUT) storage unit structured to store therein, for each of the light-emitting elements, an LUT showing correspondence between a parameter for varying the light-emitting properties and the amount of the driving current, and the current control unit is structured to control the amount of the driving current with reference to the LUT.

17. The image forming apparatus of claim 11, wherein the optical print head further comprises a function storage unit structured to store therein, for each of the light-emitting elements, a function for calculating the amount of the driving current from a parameter for varying the light-emitting properties, and the current control unit is structured to calculate the amount of the driving current with use of the function.

* * * * *